US011315720B2

(12) United States Patent
Uekusa et al.

(10) Patent No.: US 11,315,720 B2
(45) Date of Patent: Apr. 26, 2022

(54) REACTOR

(71) Applicant: Tamura Corporation, Tokyo (JP)

(72) Inventors: Yasuhiro Uekusa, Saitama (JP); Akihiro Shimizu, Saitama (JP)

(73) Assignee: TAMURA CORPORATION, Tokyo (JP)

( * ) Notice: Subject to any disclaimer, the term of this patent is extended or adjusted under 35 U.S.C. 154(b) by 462 days.

(21) Appl. No.: 16/534,119

(22) Filed: Aug. 7, 2019

(65) Prior Publication Data

US 2020/0051729 A1 Feb. 13, 2020

(30) Foreign Application Priority Data

Aug. 9, 2018 (JP) ..... JP2018-150052

(51) Int. Cl.
*H01F 27/24* (2006.01)
*H01F 27/22* (2006.01)
(Continued)

(52) U.S. Cl.
CPC ..... *H01F 27/22* (2013.01); *H01F 27/022* (2013.01); *H01F 27/24* (2013.01); *H01F 27/266* (2013.01);
(Continued)

(58) Field of Classification Search
CPC ..... H01F 27/22; H01F 27/022; H01F 27/266; H01F 27/2823; H01F 27/324;
(Continued)

(56) References Cited

U.S. PATENT DOCUMENTS

2013/0249666 A1* 9/2013 Suzuki ..... H01F 27/263 336/210
2014/0292456 A1* 10/2014 Suzuki ..... H01F 27/263 336/55
2015/0130576 A1* 5/2015 Suzuki ..... H01F 41/005 336/92

FOREIGN PATENT DOCUMENTS

JP 2012209333 A 10/2012
JP 2013197567 A 9/2013
(Continued)

OTHER PUBLICATIONS

Notice of Reasons for Refusal dated Mar. 15, 2022 corresponding to Japanese application No. 2018-150052.

*Primary Examiner* — Tuyen T Nguyen
(74) *Attorney, Agent, or Firm* — Nath, Goldberg & Meyer; Jerald L. Meyer

(57) ABSTRACT

A reactor includes: a reactor main body including a core formed of a powder magnetic core, a resin member covering the circumference of the core, and a coil wound around the outer circumference of the resin member; a casing which includes a bottom surface and a side wall standing upright therefrom, and which houses therein the reactor main body; and a filler molding portion formed of a cured filler, and fastening the reactor main body to the casing. The resin member is provided with a bottom opening provided in an end surface that faces the bottom surface of the casing and exposing the core, and a back-side opening provided in an end surface orthogonal to the winding direction of the coil and facing the side wall, and exposing the core. The back-side opening is provided with exposing portions which is not covered with the filler molding portion and is exposed.

6 Claims, 8 Drawing Sheets

(51) Int. Cl.

| | |
|---|---|
| ***H01F 27/26*** | (2006.01) |
| ***H01F 27/28*** | (2006.01) |
| ***H01F 27/02*** | (2006.01) |
| ***H01F 41/02*** | (2006.01) |
| ***H01F 27/32*** | (2006.01) |

(52) U.S. Cl.
CPC ..... *H01F 27/2823* (2013.01); *H01F 27/324* (2013.01); *H01F 41/0246* (2013.01)

(58) Field of Classification Search
CPC ..... H01F 41/0246; H01F 3/10; H01F 37/00; H01F 27/255
See application file for complete search history.

(56) References Cited

FOREIGN PATENT DOCUMENTS

| | | | |
|---|---|---|---|
| JP | 2015201582 | A | 11/2015 |
| JP | 2016122764 | A | 7/2016 |
| JP | 2019117836 | A | 7/2019 |

* cited by examiner

REACTOR

CROSS-REFERENCE TO RELATED APPLICATION

This application is based upon and claims the benefit of priority from Japan Patent Application No. 2018-150052, filed on Aug. 9, 2018, the entire contents of which are incorporated herein by reference.

FIELD OF THE INVENTION

The present disclosure relates to a reactor.

BACKGROUND

Reactors are used in various applications including, for example, a drive system for hybrid vehicles, electric vehicles, and fuel-cell battery vehicles. For example, a conventionally known reactor applied for an in-vehicle booster circuit has a surrounding of an annular core covered with a resin by molding, and has a coil wound around the outer circumference thereof.

Such a reactor has a reactor main body which includes a core formed of a powder magnetic core formed by press molding and a coil wound around the core, and this reactor main body is housed in a casing formed of a metal such as aluminum. A filler is applied between the reactor main body and the casing, and the applied filler is cured to fill a gap between the reactor main body and the casing. That is, the reactor main body is covered with the filler. The reactor main body generates heat when a current flows through the coil. The heat generated from the reactor main body is transferred to the casing via the filler, and is dissipated.

SUMMARY OF THE INVENTION

To prevent air bubbles from entering in the filler, the filler application is carried out in a vacuum condition. By having the vacuum condition, air in the powder magnetic core at the time of press molding expands, and air bubbles are produced in the powder magnetic core. When such air bubbles remain inside the reactor, it becomes a thermal resistance. Moreover, if the air bubbles are in the filler, the filler would not be applied to the reactor main body uniformly. They might cause a disturbance in the heat dissipation by the reactor.

The present disclosure has been made in order to address the above-described technical problems, and an objective is to provide a reactor which can discharge air bubbles produced in a core to an exterior of the reactor, and which can improve a heat dissipation.

A reactor according to the present disclosure includes:

a reactor main body which includes a core formed of a powder magnetic core, a resin member having the core embedded therein, and a coil wound around an outer circumference of the resin member;

a casing which includes a bottom surface and a side wall standing upright from the bottom surface, and which houses therein the reactor main body; and a filler molding portion which is formed of a cured filler, and which fastens the reactor main body to the casing, in which the resin member is provided with a bottom opening which is provided at a location facing the bottom surface of the casing and which exposes the core, and a back-side opening which is provided at a location orthogonal to the winding direction of the coil and facing the side wall, and which exposes the core, and the back-side opening is provided with exposing portions which is not covered with the filler molding portion and is exposed.

An area of the exposing portion may be equal to or greater than 10% of an area of the bottom opening.

The core may include a step at an edge of a core surface that is exposed from the bottom opening, and the resin member may fill the step and forms a same flat plane with the core that is exposed from the bottom opening.

The core formed by press molding may include a slide surface formed by sliding a die, and the slide surface may be exposed from the back-side opening.

The core may be an annular core that includes a pair of leg portions extending in the winding direction of the coil, and the bottom opening may be provided with a first edge that extends across a range including between the pair of leg portions, and the resin member may include a projection which projects from the first edge of the bottom opening, and which is in contact with the core that is exposed from the bottom opening.

The resin member may further include linear portions that cover the pair of leg portions, respectively, and the linear portions may be provided with side openings which are in parallel with the winding direction of the coil and which are in parallel with the side wall, and the core is exposed from the side openings.

According to the present disclosure, a reactor which can discharge air bubbles produced in a core to an exterior of the reactor, and which can improve a heat dissipation is provided.

DETAILED DESCRIPTION OF THE EMBODIMENTS

First Embodiment

Figure 1:
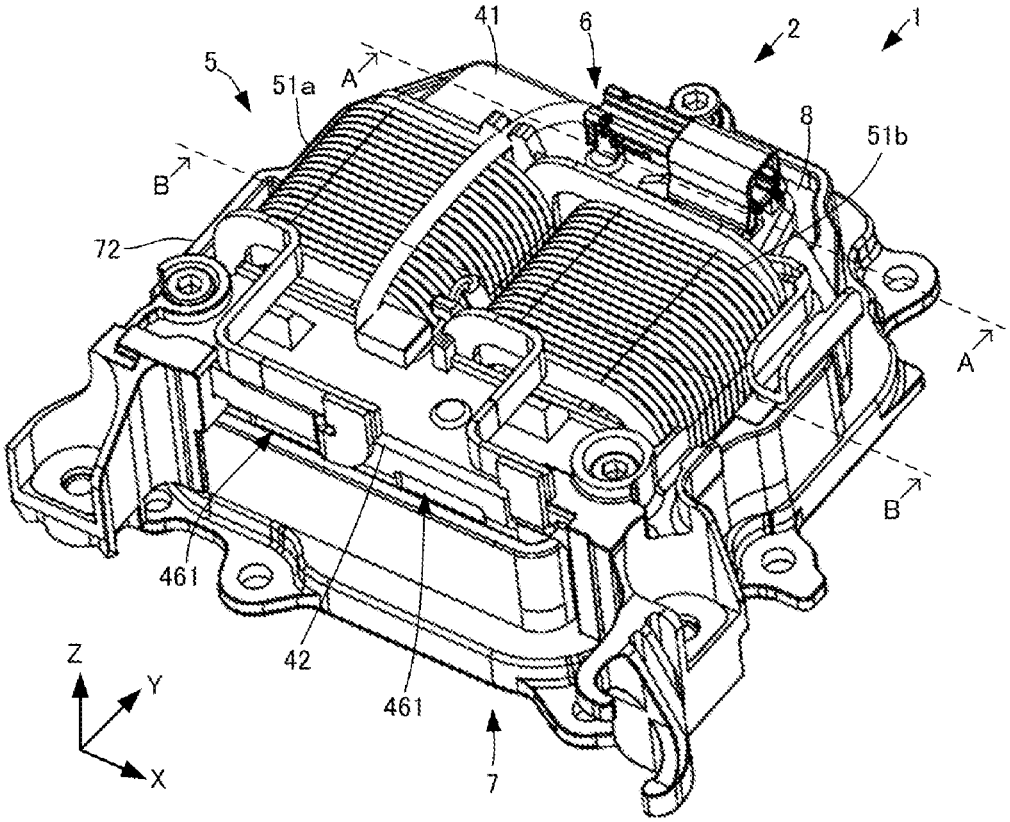
FIG. 1 is an overall perspective view of a reactor according to a first embodiment.
Figure 2:
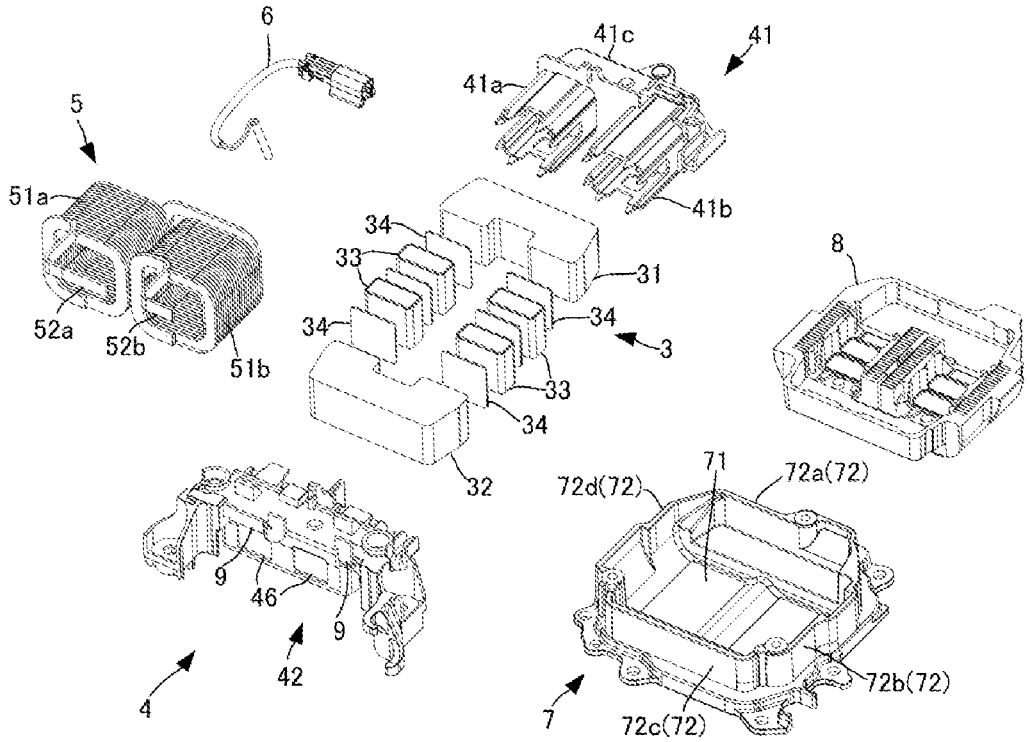
FIG. 2 is an exploded perspective view of the reactor according to the first embodiment.

A structure of a reactor according to this embodiment will be described with reference to the figures. FIG. 1 is a perspective view illustrating an overall structure of a reactor according to the first embodiment. FIG. 2 is an exploded perspective view of the reactor according to the first embodiment. Note that in this specification, the winding direction of a coil is defined as a "Y-axis direction". A direction which is orthogonal to the Y axis-direction, and which is parallel to the direction in which two coils 51*a* and 51*b* adjoin to each other is defined as an "X-axis direction". A direction that is orthogonal to the X-axis direction and to the Y-axis direction is defined as a "Z-axis direction", and the Z-axis direction represents the height direction of the reactor. A direction indicated by an arrow in the Z-axis direction in FIG. 1 is defined as an "upper" side, and the opposite direction thereto is defined as a "lower" side. The term "lower" is also called a "bottom". These directions are merely expressions for describing positional relations of each component of the reactor, and are not intended to limit the positional relation and direction when the reactor is installed on an installation object.

A reactor 1 is an electromagnetic component which converts electric energy into magnetic energy, and accumulates and releases such energy, and is utilized for voltage increase or decrease, etc. The reactor 1 according to this embodiment is a large-capacity reactor utilized in, for example, a drive system for hybrid vehicles and electric vehicles, etc. The reactor is a primary component of a booster circuit loaded in such vehicles.

As illustrated in FIG. 1 and FIG. 2, the reactor 1 according to this embodiment includes a reactor main body 2, a casing 7, and a filler molding portion 8. The reactor main body 2 includes a core 3, a resin member 4, a coil 5, and a temperature sensor 6. The reactor main body 2 is housed in the casing 7. By applying a filler in the casing 7, the reactor main component 2 is fastened to the casing 7, and the filler molding portion 8 is formed.

The core 3 is formed in an annular shape that includes a pair of linear portions placed in parallel with each other extending in the winding direction of the coil 5, and connection portions in a substantially U-shape to connect the pair of linear portions. That is, the core 3 is in an annular shape that is a substantially rectangular shape with rounded corners formed by placing convex sides of a pair of partial rings in opposite directions to each other so as to face with each other with a distance therebetween, and connecting respective both ends of the partial rings to each other by respective parallel linear portions.

The linear portion around which the coil 5 is wound is a leg portion where magnetic fluxes are produced. The coupling portion where no coil 5 is wound is a yoke portion through which the magnetic fluxes produced at the leg portion pass. As described above, an annular closed magnetic circuit is formed in the core 3 by the magnetic fluxes produced at the leg portion passing through the yoke portion.

The core 3 includes a plurality of I-shaped cores 33 that forms the leg portions, two U-shaped cores 31 and 32 that form the yoke portions, and a plurality of spacers 34. The spacer 34 is placed between the I-shaped cores 33 or between the U-shaped cores 31 and 32, and the I-shaped core 33. The U-shaped cores 31 and 32 and the I-shaped cores 33 are joined by an adhesive via the spacers 34, so that the core 3 becomes an annular core.

Figure 3:
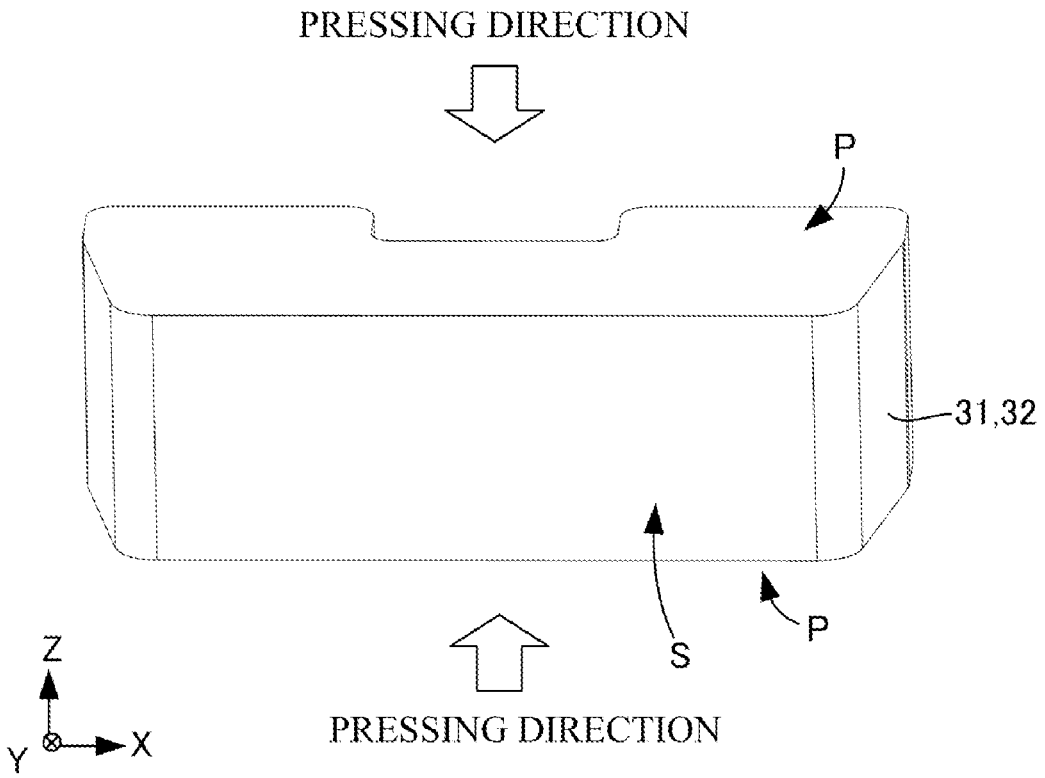
FIG. 3 is a perspective view of a U-shaped core according to the first embodiment.

FIG. 3 is a perspective view of each U-shaped core 31 and 32. The U-shaped core 31 and 32 is formed of a powder magnetic core. The U-shaped core 31 and 32 is formed by filling a die with magnetic powders wrapped by an insulation film, etc., and pressing the die. As illustrated in FIG. 3, each U-shaped core 31 and 32 has press surfaces P which are two pressed end faces in the Z-axis direction, and a slide surfaces S formed by sliding a molding die.

Figure 4:
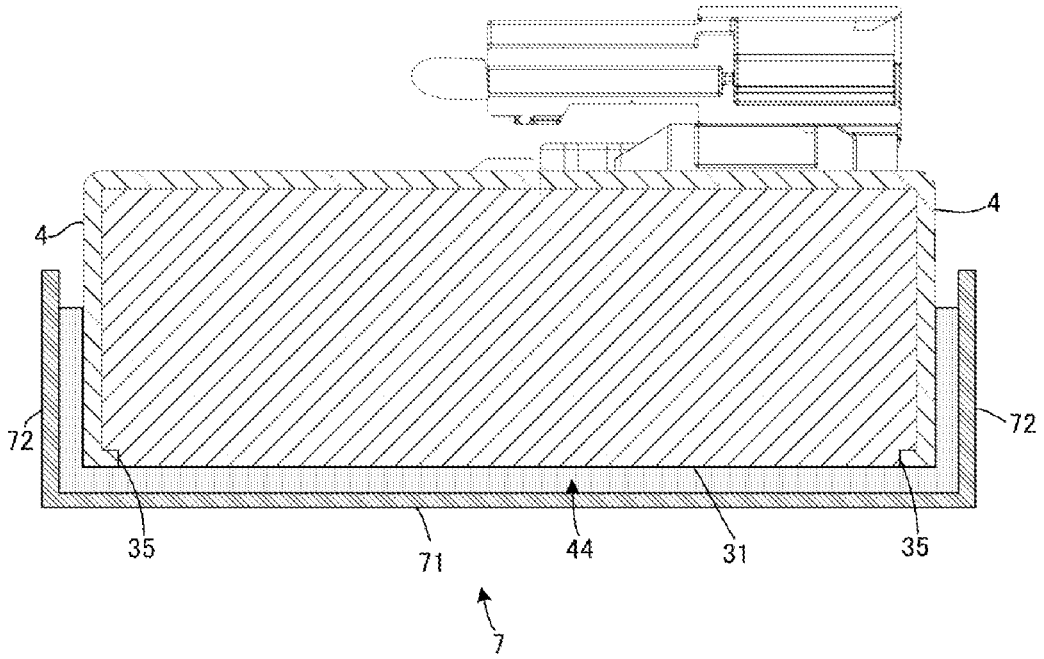
FIG. 4 is a cross-sectional view taken along a line A-A in FIG. 1.

FIG. 4 is a cross-sectional view taken along a line A-A in FIG. 1. More specifically, FIG. 4 is a cross-sectional view which is cut along a dashed line indicated as A-A in FIG. 1 in parallel with the height direction, and which is viewed from the winding direction (a viewing direction along an arrow). As illustrated in FIG. 4, a surface exposed from a bottom opening 44 of the U-shaped core 31 (also referred to as the bottom surface of the core 3 below) is in a shape that has a step 35 at an edge. By filling the step 35 located at the edge by the resin member 4, the bottom surface of the core 3 and the resin member 4 become a flat plane. Note that the bottom surface of the U-shaped core 32 also has the step 35 like the U-shaped core 31.

The spacer 34 is a gap spacer in a plate shape. The spacer 34 provides a magnetic gap with a predetermined width between the cores, and prevents a reduction in inductance of the reactor. Example spacers 34 applicable are nonmagnetic substance, ceramic, nonmetal, resin, carbon fiber, a combination of two more of those, or a gap paper. It is not always necessary to provide the spacer 34, and the U-shaped cores 31 and 32 and the I-shaped core 33 may be directly connected by an adhesive, or an air gap may be provided.

The core 3 is embedded in the resin member 4, and so that the core 3 is insulated from the coil 5. Example kinds of the resin that forms the resin member 4 are an epoxy resin, an unsaturated polyester-based resin, an urethane resin, a Bulk Molding Compound (BMC), a Polyphenylene Sulfide (PPS), and a Polybutylene Terephthalate (PBT), etc.

As illustrated in FIG. 2, the resin member 4 is divided into two pieces of a resin member 41 and a resin member 42. That is, the resin member 4 has the resin member 41 and the resin member 42 molded separately. The resin member 41 includes a pair of linear portions 41*a* and 41*b*, and a coupling portion 41*c* that connects the linear portions 41*a* and 41*b*. Moreover, respective ends of the linear portions 41*a* and 41*b* of the resin member and the ends of the resin member 42 are joined to form the resin member 4

The resin members 41 and 42 have the U-shaped cores 31 and 32 embedded therein by molding. In other words, the resin members 41 and 42 are covering portions of the U-shaped cores 31 and 32, and the outer circumference of the U-shaped core 31 are in close contact with the inner circumferences of the resin members 41 and 42. As illustrated in FIG. 4, at the end surface of the resin members 41 and 42 facing the bottom surface 71 of the casing 7, the U-shaped core 31 and the resin member 41 are in the same plane. That is, at the time of molding, a resin that becomes the resin member 41 fills the portion that is the step 35 of the U-shaped core 31, and the resin member 41 forms the same flat plane with the bottom surface of the U-shaped core 31. Note that the resin member 42 also forms the same flat plane with the bottom surface of the U-shaped core 32 like the resin member 41.

Figure 5:
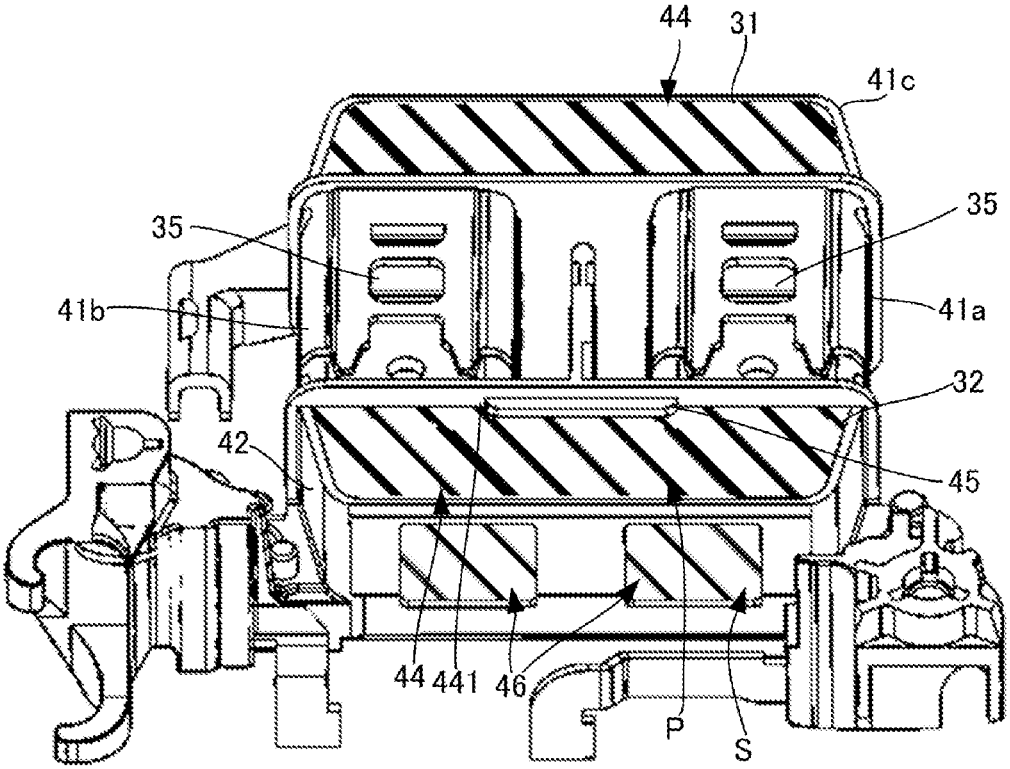
FIG. 5 is a bottom perspective view of a reactor main body according to the first embodiment.

FIG. 5 is a bottom perspective view of the reactor main body. As illustrated in FIG. 5, the resin members 41 and 42 have a bottom opening 44 formed in a substantially trapezoidal shape in respective end surfaces opposite to the bottom surface 71 of the casing 7. The bottom surfaces of the U-shaped cores 31 and 32 are exposed from the bottom opening 44. Inclined lines in FIG. 5 indicate the U-shaped cores 31 and 32. The end surfaces of the U-shaped cores 31 and 32 (the bottom surface of the core) exposed from the bottom opening 44 are the press surfaces P at the bottom side.

The bottom opening 44 includes a first edge 441 that extends within a range which includes at least a space between a pair of the leg portions 35 of the core 3 extending in the winding direction. The first edge 441 is orthogonal in the winding direction of the coil 5 to the bottom opening 44 that is opened in a substantially trapezoidal shape, and is provided at a location near the coil 5. In other words, the first edge 441 is provided on a line that interconnects respective ends of the pair of leg portions 35 of the core 3.

Moreover, the resin members 41 and 42 have a projection 45. The projection 45 projects from the first edge, and is in contact with the core 3 exposed from the bottom opening 44. The projection 45 has an entire surface facing the core 3 that is exposed from the bottom opening 44 in contact with this core 3. The projection 45 is provided at a center position of a length side of the bottom side of the bottom opening 44 opened in a substantially trapezoidal shape. That is, the projection 45 projects from between the pair of leg portions of the core 3. The projection 45 is in a thin and flat plate shape. The projection 45 is provided so that a long side thereof is in parallel with the X-axis direction.

The projection 45 prevents air bubbles inside the U-shaped cores 31 and 32 from escaping through the bottom opening 44. That is, the projection 45 prevents air bubbles from escaping from between the pair of leg portions 35 extending linearly relative to the U-shaped cores 31 and 32. Hence, the projection 45 is in contact with the U-shaped cores 31 and 32. The length side of the projection 45 has a substantially same length to a length between the pair of leg portions 35 extending linearly relative to the U-shaped cores 31 and 32.

The projection 45 is formed integrally when the resin members 41 and 42 are molded. Note that the projection 45 may be formed separately from the resin members 41 and 42, and may be joined to the resin members 41 and 42 by an adhesive, etc., after the resin members 41 and 42 which have the U-shaped cores 31 and 32 embedded therein by molding are formed.

As illustrated in FIG. 2 and FIG. 5, the resin member 42 has two back-side openings 46 in an end surface which is orthogonal to the winding direction of the coil 5 and which faces a side wall 72 of the casing 7. The back-side openings 46 expose the U-shaped core 32. More specifically, the back-side openings 46 expose the slide surface S of the U-shaped core 32. The back-side opening 46 is formed in a substantially rectangular shape. Note that the resin member 41 also has the back-side openings 46 like the resin member 42, and the back-side openings 46 of the resin member 41 expose the U-shaped core 31. More specifically, the back-side openings 46 of the resin member 41 expose the slide surface S of the U-shaped core 31.

Figure 6:
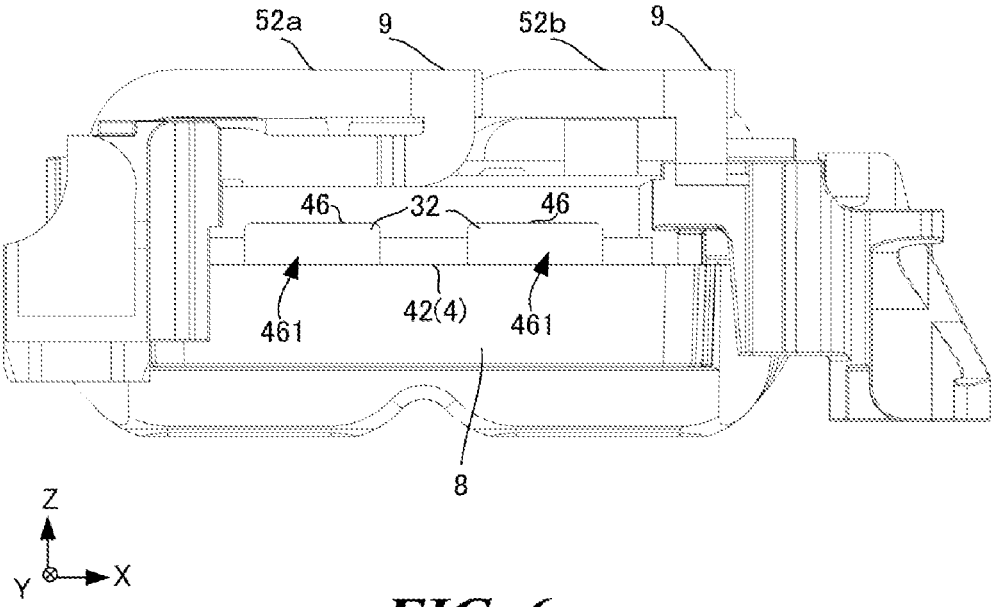
FIG. 6 is a side view illustrating a state in which a filler molding portion covers the reactor main body according to the first embodiment.

FIG. 6 is a side view (the casing 7 is unillustrated) for the reactor main body 2 covered with the filler molding portion 8 when viewed in the winding direction. As illustrated in FIG. 6, back-side opening 46 has an exposing portion 461 which is not covered with the filler molding portion 8. In other words, the back-side opening 46 includes a portion that is covered with the filler molding portion 8, and another portion that is not covered with the filler molding portion 8. The exposing portion 461 exposes the slide surface S of the U-shaped core 31 or 32. That is, the U-shaped cores 31 and 32 each have a portion which is not covered with the resin member 4 and with the filler molding portion 8, and is exposed.

The expose portion 461 becomes an escapeway for the air bubbles produced in the core 3 when a filler is applied. It is preferable that the area of the expose portions 461 is equal to or greater than 10% of the area of the bottom opening 46. When the area of the expose portions 461 is equal to or greater than 10% of the area of the bottom opening 46, the air bubbles can be discharged well to the exterior of the reactor.

The linear portions 41*a* and 41*b* of the resin member 41 have respective side openings 47. The side openings 47 are provided in end surfaces of the linear portions 41*a* and 41*b* which are in parallel with the Y-axis direction, and which are in parallel with the side wall 72 of the casing 7. The side opening 47 exposes the core 3.

The coil 5 is formed of a single conductive member coated with an enamel etc., for insulation. In this embodiment, an edgewise coil of a flat wire formed of a copper wire is adopted. Needless to say, the material of the coil 5 and the way of winding are not limited to this example, and other forms may be employed.

The coil 5 includes a pair of right and left coils 51*a* and 51*b*, and the pair of coils 51*a* and 51*b* are placed so that the winding directions are in parallel with each other. The end portions of the coils 51*a* and 51*b* are coupled to each other by a coupling portion 41*c* which is formed of the same material as those of the coils 51*a* and 51*b*. The coils 51*a* and 51*b* include drawn wires 52*a* and 52*b* which are joined to a terminal 9 by welding, etc., and are electrically connected to an external apparatus.

The temperature sensor 6 detects a temperature of the reactor 1. Although a thermistor that changes an electrical resistance relative to a temperature is applicable as the temperature sensor 6, the present disclosure is not limited to this example. The temperature sensor 6 is electrically connected to an apparatus installed outside the reactor 1, and transmits temperature information of the reactor 1 to the external apparatus.

The casing 7 houses therein the reactor main body 2. The casing 7 is formed in a box shape that has an opened upper surface. That is, the casing 7 includes the bottom surface 71 formed in a substantially rectangular shape, and side walls 72*a*, 72*b*, 72*c*, and 72*d* standing upright from the four side edges of the bottom surface 71 in the height direction, and the upper surface is opened. The reactor main body 2 is fitted in the housing space of the casing 7 through this opening. The housing space is surrounded by the bottom surface 71 and the side walls 72*a*, 72*b*, 72*c*, and 72*d*.

The housing space of the casing 7 is slightly larger than the reactor main body 2. In other words, the side walls 72*a*, 72*b*, 72*c*, and 72*d* of the casing 7 are slightly larger than the reactor main body 2 so as to surround the circumference of the reactor main body 2. Accordingly, a space is formed between the side walls 72*a*, 72*b*, 72*c*, and 72*d* of the casing 7 and the reactor main body 2. The height of the casing 7 in the Z-axis direction, that is, the height of the side wall 72 is lower than the height of the reactor main body 2 in the Z-axis direction. Note that the height of the side wall 72 may be equal to the height of the reactor main body 2, or may be higher.

The filler molding portion 8 is formed by filling a space between the reactor main body 2 and the casing 7 with a filler, and causing the filler to be cured. That is, the filler molding portion 8 is formed in the space between the reactor main body 2 and the casing 7. The filler molding portion 8 fastens the reactor main body 2 to the casing 7. An example suitable filler is a resin which is relatively soft and which has high thermal conductivity to ensure the heat dissipation by the reactor 1 and to reduce a vibration transmission to the casing 7 from the reactor main body 2. More specifically, a silicon resin, a urethane resin, an epoxy resin, and an acrylic resin, etc., may be exemplified.

The filler molding portion 8 does not cover the entire back-side opening 46. In other words, the back-side opening 46 includes the exposing portions 461 that are exposed from the filler molding portion 8.

Assembling Operation

An assembling operation for the reactor 1 according to this embodiment will be described. As described above, the resin member 41 that has the U-shaped core 31 embedded therein and the resin member 42 that has the U-shaped core 32 and the terminal 9 embedded therein are formed by resin molding. The I-shaped cores 33 and the spacers 34 are inserted in the interiors of the linear portions 41*a* and 41*b* of the resin member 41, and the U-shaped cores 31 and 32, the I-shaped cores 33, and the spacers 34 are joined together by an adhesive, etc.

The main reactor main body 2 is formed by attaching the coils 51*a* and 51*b* to the exterior of the linear portions 41*a* and 41*b*, and joining the end portions of the resin members 41 and 42 divided into two pieces. Subsequently, the reactor main body 2 is housed in the casing 7. After the housing, the filler is applied from an inlet 73. The applied filler is cured, and forms the filler molding portion 8, and the reactor 1 is obtained.

Action

According to the core 3 that is formed of a powder magnetic core, air bubbles enters inside the core 3 at the time of press molding. On the other hand, when the filler is applied, to prevent air bubbles from entering in the filler, it is necessary to apply the filler in a vacuum condition. At this time, due to vacuum condition, air contained in the core 3 expands, and thus air bubbles are produced. In order to ensure the heat dissipation, it is necessary to discharge the produced air bubbles to the exterior of the reactor 1.

Figure 7:
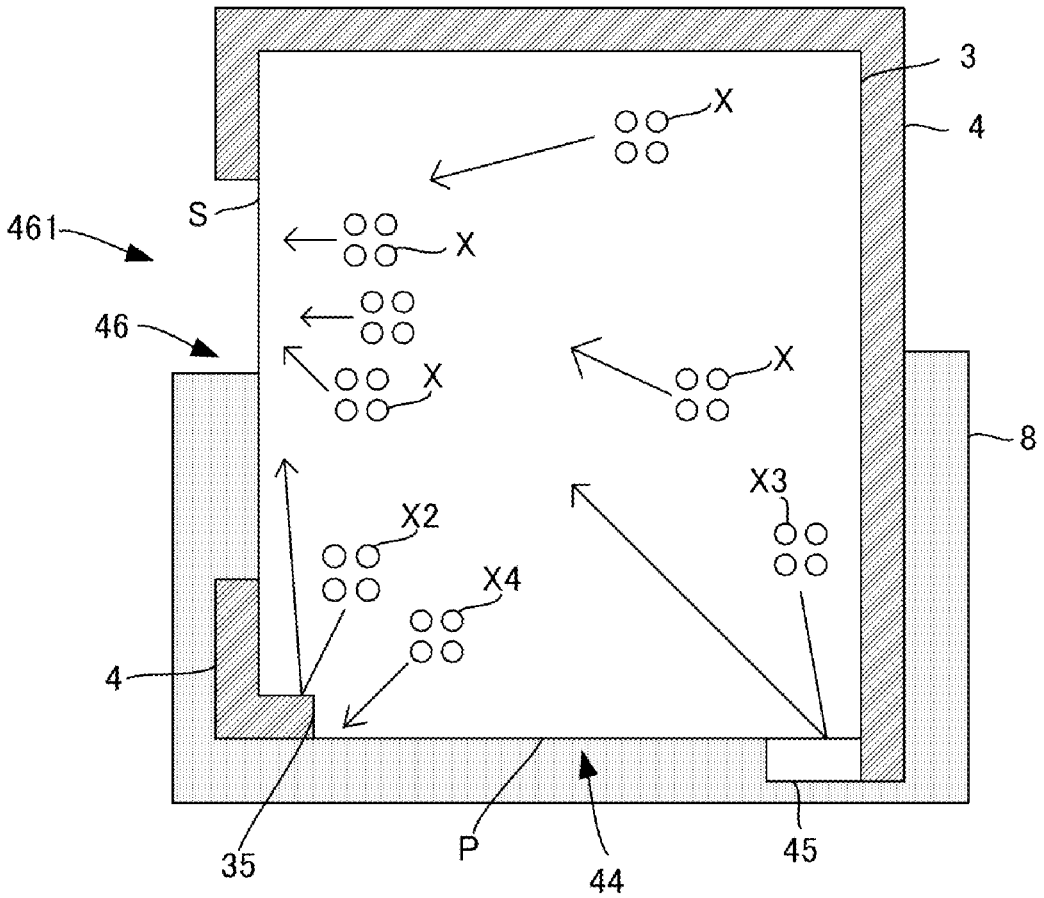
FIG. 7 is a schematic diagram illustrating a movement of air bubbles inside a core.

FIG. 7 is a schematic diagram illustrating a movement of air bubbles X in the core. According to this embodiment, the resin members 41 and 42 have the bottom opening 44 and the back-side opening 46. The air bubbles X can be discharged through these openings 44 and 46 to the exterior of the reactor 1. In particular, the back-side opening 46 includes the exposing portions 461 that are not covered with the resin member 4 and the filler molding portion 8. The openings 44 and 46 other than the exposing portions 461 are covered with the filler that forms the filler molding portion 8. Since the filler has a viscosity, the air bubbles X are not easily discharged in comparison with air, and when the air bubbles X are entered in the filler, there is a possibility that the filler cannot be applied uniformly to the reactor main body 2. According to this embodiment, since the exposing portions 461 that are not covered with the filler are provided, the air bubbles X are likely to be discharged to the exterior of the reactor 1 through the exposing portions 461. Since air bubbles X travel in a direction to be easily discharged to the exterior, as illustrated in FIG. 7, the number of air bubbles X that travel toward the exposing portions 461 increases. Accordingly, more air bubbles X can be discharged to the exterior of the reactor through the exposing portions 461.

The slide surface S of the U-shaped core 31 or 32 is exposed from the back-side opening 46 and the exposing portions 461. Furthermore, the press surfaces P of the U-shaped cores 31 and 32 are exposed from the bottom opening 44. When press molding is executed, air contained in the U-shaped cores 31 and 32 assembles in the slide surface S. More specifically, since large pressure is applied to the press surface P of the core 3 when pressed, the air contained in the U-shaped cores 31 and 32 travel in the direction going away from the press surface P. Next, the air that has traveled in the direction going away further travel toward the direction of the slide surface S so as to be discharged to the exterior of the U-shaped cores 31 and 32. As described above, the air that was trapped in the U-shaped cores 31 and 32 at the time of press molding assembles near the slide surface S.

Moreover, since larger pressure than that of to the slide surface S is applied to the press surface P, in comparison with the slide surface S, the press surface P is formed with less gaps and is densified than the slide surface S. In contrast, since the slide surface S slides the die, the surface of the slide surface S that slides over the mold has larger number of concavities and convexities than the press surface P such that the air bubbles X trapped in the core 3 are likely to be discharged to the exterior. That is, the air bubbles X are discharged more from the sliding surface S than the press surface P. Accordingly, a further large air bubbles X can be discharged to the exterior of the reactor through the back-side opening 46 that exposes the slide surface S of the core 3, in particular, through the exposing portions 461 of the back-side opening 46.

According to this embodiment, the edges of the U-shaped cores 31 and 32 that are the press surfaces P exposed from the bottom opening 44 include the step 35, and the resin member 4 covers the U-shaped cores 31 and 32 so as to fill the step 35. The air bubbles X are likely to be discharged from the edge of the core 3. Accordingly, since this resin member 4 covers the step 35 at the bottom surfaces of the U-shaped cores 31 and 32, this resin member 4 serves as a shield that blocks the discharge path for air bubbles X2.

More specifically, as illustrated in FIG. 7, the resin member 4 that fills the step 35 prevents the air bubbles X2 from being discharged through the bottom opening 44, and causes the air bubbles X2 to travel toward the exposing portions 461. In other words, by reducing the number of air bubbles X2 being discharged through the bottom opening 44, the number of air bubbles X that travel toward the exposing portions 461 is increased. Accordingly, the number of air bubbles X that can be discharged to the exterior of the reactor 1 through the exposing portions 461 can be increased.

In particular, when the area of the exposing portions 461 is equal to or greater than 10% of the area of the bottom opening 44, the air bubbles X to be discharged from the exposing portions 461 will remarkably appear. It is assumed that since the area of the exposing portions 461 increases and the amount of air bubbles X that can be discharged from the exposing portions 461 can be increased by setting the area of the exposing portion 461 to be equal to or greater than 10% of the area of the bottom opening 44, the amount of the air bubbles X that travel toward the exposing portions 461 increases.

Moreover, since the bottom opening 44 is provided, there are also air bubbles X3 that travel toward the bottom opening 44, and in particular, the air bubbles X3 are likely to escape from between the pair of leg portions 35 extending in the winding direction of the core 3 which is exposed from the bottom opening 44. However, since the bottom opening 44 is covered with the filler, in comparison with the exposing portions 461, it is not easy for the air bubbles X3 to be discharged to the exterior of the reactor 1. Hence, it is desirable to cause the air bubbles X3 to travel toward the exposing portions 461 as much as possible.

According to this embodiment, the resin member 4 includes the projection 45, and the projection 45 is provided between the leg portions 35 of the core 3. That is, as illustrated in FIG. 7, the projection 45 prevents the air bubbles X3 from being discharged to the exterior from between the pair of leg portions 35 of the core 3. This makes it difficult for the air bubbles X3 to escape from the bottom opening 44 to the exterior. The air bubbles X3 that are not discharged to the exterior through this bottom opening 44 can be caused to travel toward the slide surface S where the air bubbles X3 are easily discharge to the exterior. Moreover, the air bubbles X3 that have traveled toward the slide surface S are discharged to the exterior through the exposing portions 461. Accordingly, since the resin member 4 includes the projection 45, more air bubbles X can be discharged to the exterior.

Moreover, the edges of the U-shaped cores 31 and 32 exposing from the bottom opening 44 have the step 35, and the resin member 4 covers the step 35 and forms the same flat plane together with the U-shaped cores 31 and 32. This enables the bottom opening 44 to also discharge more air bubbles X4 to the exterior.

According to conventional technologies, there is no step formed in the edge of the bottom surface exposing from the bottom opening, and the resin component covers the edge of the bottom surface of the core. That is, the core and the resin component are not formed in a same flat plane, and the resin component is formed in a projecting shape by what corresponds to a covering of the edge of the bottom surface of the core. According to such a conventional shape, air bubbles coming out from the bottom surface of the core are trapped between the core and the resin member that covers the edge of the bottom surface of the core. Accordingly, the air bubbles are blocked by the resin component that covers the edge of the bottom surface of the core from being discharged to the exterior of the reactor.

In contrast, according to this embodiment, the bottom surfaces of the U-shaped cores 31 and 32 and the resin member 4 form the same flat plane. That is, the end surfaces of the U-shaped cores 31 and 32 exposing from the bottom opening 44 are not covered with the resin member 4. The air bubbles X4 coming out from the bottom surfaces of the U-shaped cores 31 and 32 are not blocked by the resin member 4. Accordingly, the air bubbles X4 are prevented from being trapped between the U-shaped cores 31 and 32, and the resin component, and more air bubbles X can be discharged from the bottom opening 44.

Furthermore, the linear portions 41*a* and 41*b* of the resin member 41 include the side openings 47. The air bubbles X produced from the I-shaped cores 33 inserted in the linear portions 41*a* and 41*b* are not trapped inside the linear portions 41*a* and 41*b*, and can be discharged to the exterior of the reactor 1 from the side opening 47.

Effect

The reactor 1 according to this embodiment includes the reactor main body 2 that includes the core 3 which is formed of a powder magnetic core, the resin member 4 which covers the circumference of the core 3, and the coil 5 wound around the outer circumference of the resin member 4, the casing 7 which includes the bottom surface 71 and the side wall 72 standing upright from the bottom surface 71, and which houses therein the reactor main body 2, and the filler molding portion 8 which is formed of a cured filler, and which fastens the reactor main body 2 to the casing 7. The resin member 4 is provided with the bottom opening 44 which is provided in an end surface that faces the bottom surface 71 of the casing 7 and which exposes the core 3, and the back-side opening 46 which is provided in an end surface orthogonal to the winding direction of the coil 5 and facing the side wall 72, and which exposes the core 3. The back-side opening 46 is provided with the exposing portions 461 that are not covered with the filler molding portion 8 and are exposed.

Accordingly, the air bubbles X produced from the interior of the core 3 can be discharged to the exterior of the reactor 1 through the exposing portion 461 which is not covered with the resin member 4 and the filler molding portion 8, and thus a thermal resistance can be reduced. Moreover, by discharging the air bubbles X from the exposing portion 461 that is not covered with the filler, the air bubbles X are prevented from entering in the filler, and the filler can be precisely spread and applied to the reactor main body 2. Therefore, the heat dissipation by the reactor 1 can be improved.

The area of the exposing portion 461 is equal to or greater than 10% of the area of the bottom opening 44. That is, the area of the exposing portion 461 that is not covered with the resin member 4 and the filler molding portion 8 is large. Accordingly, since more air bubbles X can be discharged through the exposing portion 461, the thermal resistance can be further reduced, and the reactor 1 with an excellent heat dissipation can be obtained.

The core 3 includes the step 35 at the edge of the core 3 that is exposed from the bottom opening 44, and the resin member 4 fills the step 35 and forms the same flat plane with the core 3 that is exposed from the bottom opening 44. Accordingly, the resin member 4 that fills the step of the core 3 can suppresses the air bubbles X traveling toward the bottom opening 44, and can cause the air bubbles to travel toward the exposing portion 461, and more air bubbles X can be discharged to the exterior of the reactor 1. Moreover, since the core 3 that is exposed from the bottom opening 44 and the resin member 4 forms the same flat plane, there is no air bubble X that is blocked by the resin member 4, and the air bubbles X trapped between the resin member 4 and the core 3 are suppressed. Hence, the air bubbles X can be discharged efficiently also through the bottom opening 44. Therefore, the heat dissipation by the reactor 1 can be improved.

Moreover, the resin member 4 include the bottom opening 44 and the back-side opening 46, and the filler molding portion 8 formed of the cured filler covers the space between the core 3 that is exposed from the bottom opening 44 and the back-side opening 46, and the casing 7. Hence, heat from the reactor main body 2 can be efficiently transferred to the casing 7 through the bottom opening 44 and the back-side opening 46 via the filler, and the heat dissipation by the reactor 1 can be further improved.

The core 3 formed by press molding includes the slide surface S that slides a die, and the slide surface S is exposed from the back-side opening 46. Since the slide surface S discharges the air bubbles X to the exterior of the reactor 1 easier than the press surface P, more air bubbles X can be discharged through the exposing portion 461. Therefore, the air bubbles X trapped in the reactor 1 can be suppressed, and the heat dissipation by the reactor 1 can be improved.

The core 3 is an annular core that includes the pair of leg portions 35 extending in the winding direction of the coil 5, and the bottom opening 44 is provided with the first edge 441 that extends across a range including between the pair of leg portions 35. The resin member 4 includes the projection 45 which projects from the first edge 441 of the bottom opening 44, and which is in contact with the core 3 that is exposed from the bottom opening 44. This can cause the air bubbles X to travel not toward the bottom opening 44 but toward the exposing portion 461, and more air bubbles X can be discharged to the exterior of the reactor 1. Therefore, the heat dissipation by the reactor 1 can be improved.

The resin member 4 further includes the linear portions 41*a* and 41*b* that cover the pair of leg portions 35, respectively, and the linear portions 41*a* and 41*b* are provided with the side openings 47 formed in respective side surfaces which are in parallel with the winding direction of the coil 5 and which are in parallel with the side wall 72. The core 3 is exposed from the side openings 47. This enables the air bubbles X produced from the I-shaped cores 33 to be discharged to the exterior of the reactor 1, and the heat dissipation by the reactor 1 can be improved.

Moreover, the filler covers between the cores 3 that is exposed from the side opening 47, and the casing 7. This enables heat generated by the reactor main body 2 to be efficiently transferred to the casing 7 via the filler, and the heat dissipation by the reactor 1 can be improved.

Example

An example according to the present disclosure will be described with reference to table 1, and in comparison with a comparative example. The reactor 1 according to the example employed the same structure as that of the reactor as described in the first embodiment. That is, the resin member 4 was provided with the bottom opening 44, the back-side opening 46, and the projection 45, and the back-side opening 46 was provided with the exposing portions 461 that were not covered with the filler molding portion 8. In contrast, according to a reactor of the comparative example, a resin member was provided with a bottom opening and a back-side opening, and the back-side opening was provided with exposing portions. That is, the difference between the example and the comparative example is whether or not the resin component was provided with the projection.

Respective initial temperatures of the reactors and respective temperatures thereof after a reliability test according to the example and to the comparative example were measured. The temperature measurement was carried out under a condition in which a core loss was 94 W, a coil loss was 200 W, and a water-cooling temperature was 60° C. Moreover, the temperature after the reliability test was a temperature measured under the above-described condition after the reactor was left for 100 hours in an environment where an ambient temperature was 170° C. The results are shown in table 1.

TABLE 1

| | | Between Coils | Coil Upper Surface | I-shaped Core Upper Surface |
|---|---|---|---|---|
| Comparative Example | Initial Temperature | 122.9° C. | 122.9° C. | 122.5° C. |
| | Temperature after Reliability Test | 134.1° C. | 134.3° C. | 136.2° C. |
| | Difference | 11.2° C. | 11.4° C. | 13.7° C. |
| Example | Initial Temperature | 112.3° C. | 114.9° C. | 116.1° C. |
| | Temperature after Reliability Test | 118.0° C. | 121.8° C. | 124.3° C. |
| | Difference | 5.7° C. | 6.9° C. | 8.2° C. |

Figure 8:
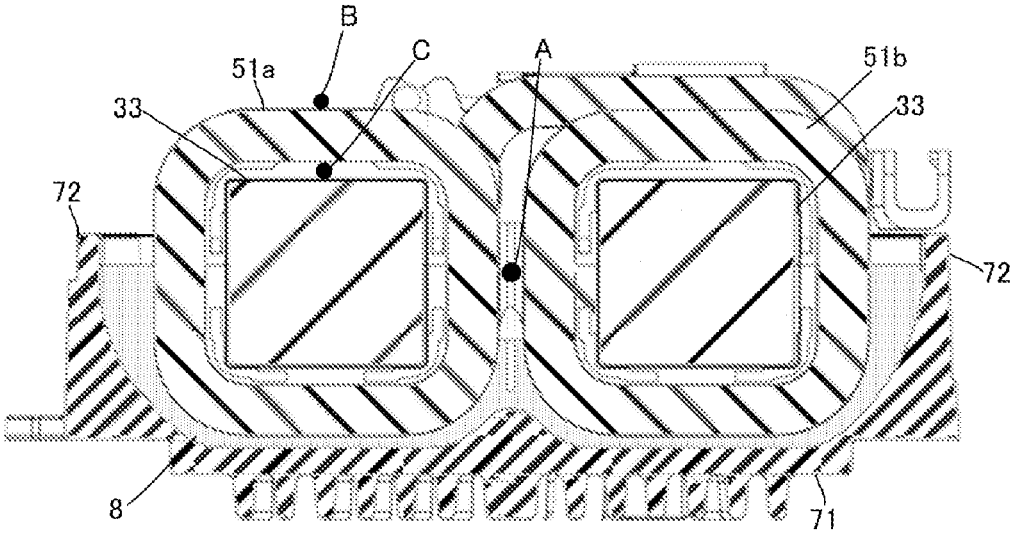
FIG. 8 is a cross-sectional view taken along a line B-B in FIG. 1 for indicating a temperature measuring location according to an example.

As shown in table 1, as for the example and the comparative example, temperatures at three locations of between the coils, the coil upper surface, and the I-shaped core upper surface were measured. The term "between the coils" is, as illustrated in FIG. 8A, between two coils placed so that the respective winding directions were in parallel with each other, and is a temperature at a center portion between the coils in the Y-axis direction and in the Z-axis direction. The term "coil upper surface" is, as illustrated in FIG. 8B, a temperature at a center portion of an upper surface of the one coil in the X-axis direction and in the Y-axis direction. The term "I-shaped core upper surface" is, as illustrated in FIG. 8C, an upper surface of the I-shaped core placed in the inner circumference of the coil, that is, between the coil and the I-shaped core, and is a temperature at a center portion of the I-shaped in the X-axis direction.

As shown in table 1, the initial temperature of the example was lower than the initial temperature of the comparative example at all the measurement locations. Moreover, in comparison with the comparative example, the example had the initial temperature after the reliability test and the temperature after the reliability test in all the measurement locations lower by substantially 5° C. That is, in comparison with the comparative example, the example had no temperature rise occurred after the reliability test.

This can be considered as a result of discharging more air bubbles X to the exterior of the reactor 1 through the exposing portions 461 by providing the projection 45. More specifically, since the comparative example had no projection, air bubbles were produced between the bottom surface of the core and the casing, and it was difficult to uniformly fill the filler. Moreover, in the comparative example, since it was left for a long time under a high-temperature condition in which the ambient temperature was 170° C., the air bubbles produced between the core and the casing were expanded, and the filler that was filled between the core and the casing was peeled off. In view of the foregoing, since the comparative example was unable to efficiently transfer heat generated by reactor main body to the casing via the filler, the temperature rise was large in the comparative example.

In contrast, according to the example that had the projection 45, since more air bubbles were discharged to the exterior of the reactor 1 through the exposing portion 461, a production of the air bubbles X between the bottom surface of the core 3 and the casing 7 was suppressed. In other words, the example can suppress the air bubbles X from entering in the filler, and enables the filler to be uniformly filled relative to the reactor main body 2. Accordingly, even if the reliability test is executed, the air bubbles X hardly expand and the filler is not peeled off, and the excellent heat dissipation is maintained. Therefore, the example which has improved heat dissipation by the reactor 1 achieves a result such that the initial temperature was low at all the measurement locations in comparison with the comparative example, and the temperature rise after the reliability test was also low.

Other Embodiments

Although the embodiment according to the present disclosure has been described in the specification, this embodiment is merely presented as an example, and is not intended to limit the scope of the present disclosure. The above-described embodiment can be carried out in other various forms, and various omissions, replacements, and modifications can be made thereto without departing from the scope of the present disclosure. Such embodiments and modified forms thereof are within the scope and spirit of the present disclosure, and also within the scope of the invention as recited in the appended claims and the equivalent range thereto.

In the above-described embodiment, although the resin members 41 and 42 are provided with the back-side opening 46 that is opened in a substantially rectangular shape, the shape of the back-side opening 46 is not limited to this example. As long as the area of the exposing portions 461 is equal to or greater than 10% of the area of the bottom opening 44, the back-side opening 46 may be a circular opening. Moreover, regarding the number of back-side openings 46, as long as the total area of the multiple exposing portions is equal to or greater than 10% of the area of the bottom opening 44, the resin members 41 and 42 may be provided with the single back-side opening 46 that is opened largely, or may be provided with the equal to or greater than two back-side openings 46.

What is claimed is:

1. A reactor comprising:

a reactor main body which comprises a core formed of a powder magnetic core, a resin member having the core embedded therein, and a coil wound around an outer circumference of the resin member;

a casing which comprises a bottom surface and a side wall standing upright from the bottom surface, and which houses therein the reactor main body; and a filler molding portion which is formed of a cured filler, and which fastens the reactor main body to the casing, wherein the resin member is provided with:

a bottom opening which is provided at a location facing the bottom surface of the casing and where the coil is not wound, and which exposes the core; and a back-side opening which is provided at a location orthogonal to a winding direction of the coil and facing the side wall, and which exposes the core, and wherein the back-side opening is provided with an exposing portion that is not covered with the filler molding portion and is exposed.

2. The reactor according to claim 1, wherein an area of the exposing portion is equal to or greater than 10% of an area of the bottom opening.

3. The reactor according to claim 1, wherein;

the core comprises a step at an edge of a core surface that is exposed from the bottom opening, and the resin member fills the step and forms a same flat plane with the core surface that is exposed from the bottom opening.

4. The reactor according to claim 1, wherein:

the core formed by press molding comprises a slide surface formed by sliding a die, and the slide surface is exposed from the back-side opening.

5. The reactor according to claim 1, wherein:

the core is an annular core that comprises a pair of leg portions extending in the winding direction of the coil, the bottom opening is provided with a first edge that extends across a range including between the pair of leg portions, and the resin member comprises a projection which projects from the first edge of the bottom opening, and which is in contact with the core that is exposed from the bottom opening.

6. The reactor according to claim 5, wherein:

the resin member further comprises linear portions that cover the pair of leg portions, respectively, and the linear portions have side openings formed in side surfaces which are in parallel with the winding direction of the coil and which are in parallel with the side wall, and the core is exposed from the side openings.

* * * * *